US006205835B1

(12) United States Patent
Balve et al.

(10) Patent No.: US 6,205,835 B1
(45) Date of Patent: Mar. 27, 2001

(54) ROLL STAND ARRANGEMENT FOR ROLLING WIRE

(75) Inventors: Karl-Heinz Balve; Karl Keller, both of Hilchenbach; Klaus Hoffmann, Düsseldorf; Hans-Georg Hartung, Pulheim; Georg Kleinefeldt, Ratingen, all of (DE)

(73) Assignee: SMS Schloemann-Siemag Aktiengesellschaft, Düsseldorf (DE)

( * ) Notice: Subject to any disclaimer, the term of this patent is extended or adjusted under 35 U.S.C. 154(b) by 0 days.

(21) Appl. No.: 09/457,622

(22) Filed: Dec. 8, 1999

(30) Foreign Application Priority Data

Dec. 14, 1998 (DE) ..... 198 57 300
Apr. 30, 1999 (DE) ..... 199 19 778

(51) Int. Cl.[7] ..... B21B 39/00; B21B 13/08
(52) U.S. Cl. ..... 72/234; 72/250; 72/226
(58) Field of Search ..... 72/234, 226, 235, 72/250, 227

(56) References Cited

U.S. PATENT DOCUMENTS 3,837,207 * 9/1974 Tarmann ..... 72/366
4,070,893 * 1/1978 Nishikubo et al. ..... 72/234
5,595,083 * 1/1997 Shore ..... 72/234
6,053,022 * 9/1998 Shore ..... 72/238

FOREIGN PATENT DOCUMENTS 0512735 4/1995 (EP) .

* cited by examiner

*Primary Examiner*—Rodney A. Butler
(74) *Attorney, Agent, or Firm*—Friedrich Kueffner

(57) ABSTRACT

A roll stand arrangement for rolling wire with a finishing block arranged following the last stand of the intermediate group of a wire rolling mill and composed of fixedly connected roll stands with grooved rolls, and a skin pass block arranged following and having the same configuration as the finishing block, wherein the roll stands of the skin pass block have an oval/oval groove sequence and a subsequent round groove sequence. The sequence of grooves in the roll stands of the skin pass block is composed of two, three, four or more oval/oval successive grooves and, directly following these oval/oval successive grooves, one or two round successive grooves.

12 Claims, 4 Drawing Sheets

3
2b
3
4a
4
4a
4
5
STF
KWP
WR
2
1
2a

ROLL STAND ARRANGEMENT FOR ROLLING WIRE

BACKGROUND OF THE INVENTION

1. Field of the Invention

The present invention relates to a roll stand arrangement for rolling wire with a finishing block arranged following the last stand of the intermediate group of a wire rolling mill and composed of fixedly connected roll stands with grooved rolls, and a skin pass block arranged following and having the same configuration as the finishing block, wherein the roll stands of the skin pass block have an oval/oval groove sequence and a subsequent round groove sequence.

2. Description of the Related Art

Roll stand arrangements of this type have the purpose, in addition to achieving a relatively substantial reduction of the wire strand leaving the finishing block by means of the oval/oval groove sequence, to achieve by means of the round groove sequence a high dimensional accuracy of the wire strand leaving the skin pass block. In order to achieve this object, it had to be ensured that the fine grain structure of the rolled strand achieved with the significant reduction and the correspondingly high rolling temperature using the alternating oval/oval groove sequence of the finishing block, was maintained during the passes through the skin pass block, and that especially no grain growth which would have destroyed this fine grain structure could take place during the passes of the wire strand in the final sizing rolling phase through the round/round groove sequence with corresponding low reduction.

In order to meet this object, EP 512 735 B1 suggests a skin pass block whose groove sequence, in addition to an oval groove at the entry side, is composed of a sequence of two or more round grooves. Since the tendency of the wire strand to rotate between the round grooves cannot be counteracted by appropriate guide elements, the stands of this embodiment must be arranged very closely one behind the other; another even more important reason for this close arrangement is that a temperature drop which would negatively influence the fine grain structure achieved in the preceding rolling steps must be prevented.

In addition to the difficulties occurring in connection with the control of the rates of rotation of the roll stands with round groove rolls in order to maintain the necessary temperature with the slight reduction, the necessary close arrangement of the roll stands in the skin pass block makes it difficult to mount normal larger roll stands, as they are used, for example, in the finishing block, and also makes it difficult to mount flexible wire guide means, particularly roller guide means. The close arrangement of the roll stands results in additional difficulties if each roll stand is to be driven directly through an independent controllable individual drive. Because of the narrow space available, it is usually also not possible to exchange individual roll stands against roll stands with larger dimensions for using correspondingly larger roll diameters. Consequently, the roll stand arrangements of this type are not very flexible with respect to the controllable reductions as well as with respect to the range of wire diameters which can be rolled.

SUMMARY OF THE INVENTION

Therefore, it is the primary object of the present invention to improve the roll stand arrangement of the above-described type in such a way that, while maintaining the fine grain of the structure of the wire strand during the passes through the roll stands, a much greater flexibility can be achieved with respect to the selection and composition of the roll stands and rolls used, as well as with respect to the operation of such roll stand arrangements.

In accordance with the present invention, the sequence of grooves in the roll stands of the skin pass block is composed of two, three, four or more oval/oval successive grooves and, directly following these oval/oval successive grooves, one or two round successive grooves.

The reduction per groove can be dimensioned in the oval grooves with 10–28% and in the round grooves with 2.5–10%, and the diameter range of the grooved rolls can be dimensioned between 100 and 210 mm. The spacing of the roll stands with grooved rolls may be between 400 and 900 mm. The roll stands in the skin pass block can be coupled individually and/or in pairs to independent drive units. Additional shifting gear units may be arranged between the drive units and the respective roll stand.

In accordance with another feature of the invention, the pairs of grooved rolls can be arranged with their support shafts and bearings in cassettes which can be placed exchangeably in a part of the roll stand which receives the drive transmission gear unit and can be coupled to the gear unit.

The arrangement of the roll stands with grooved rolls and the guide means in front of and following these stands can be made in accordance with the present invention in such a way that, when adjustable static guide means and roller guide means are used, static guide means are used in front of and following the first roll stand with grooved rolls and a roller guide means is arranged in front of each of the subsequent roll stands and a static guide means is arranged behind each subsequent roll stand. The static guide means may be composed of a wire guide sleeve adjustably arranged in a guide housing with a subsequently arranged pair of guide rollers and the roller guide means may be composed of a wire guide sleeve and two pairs of guide rollers arranged spaced apart one behind the other. In the roller guide means, the wire guide sleeve may also be composed of two partial wire guide sleeves which are arranged in front of and between the two pairs of rollers as seen in the rolling direction.

In accordance with another feature of the invention, the pairs of rollers may be arranged at levers which support ends of two-arm levers mounted in the guide housing, wherein spring-biased adjusting elements resting against the guide housing act on the other ends of the levers. Guide projections may be arranged for the front pairs of rollers of the roller guide means as seen in the rolling direction, wherein the guide projections are connected to the guide housing and face the roll gap of the pair of grooved rollers. The spacing of the roller axes should correspond to two to four times the diameter of the rollers.

Because of the above-described oval/oval groove sequence, and because of the fact that the spacing between the stands remains relatively small, the roll stand arrangement according to the present invention makes it possible to use for each pass the static guide means provided in accordance with the present invention in the case of appropriate roll diameters. This configuration makes it possible to place pairs of grooved rolls of different sizes arranged with support shafts and bearings in exchange cassettes selectively into the roll stands and, when the skin pass block is equipped with individual drives and shifting gear units for some or all of the roll stands, to control optimum pass reductions for each of the stands or for groups of stands.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

DESCRIPTION OF THE PREFERRED EMBODIMENTS

Figure 1:
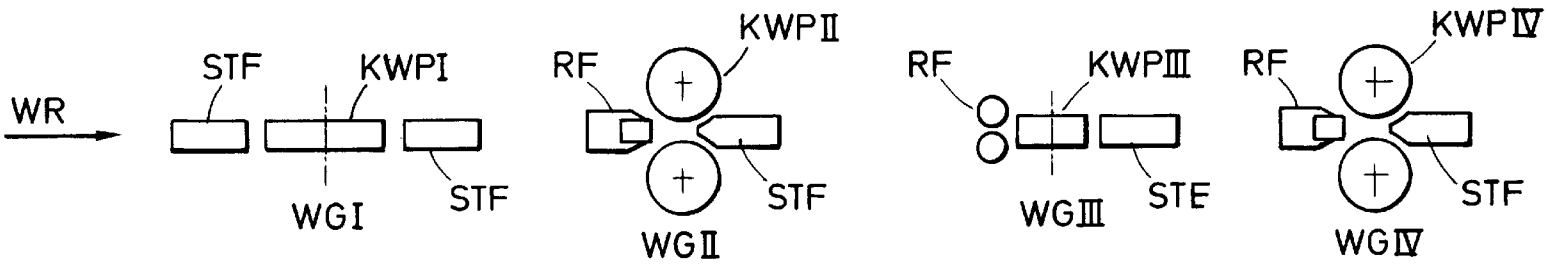
FIG. 1 is a schematic top view of a roll stand arrangement.
Figure 2:
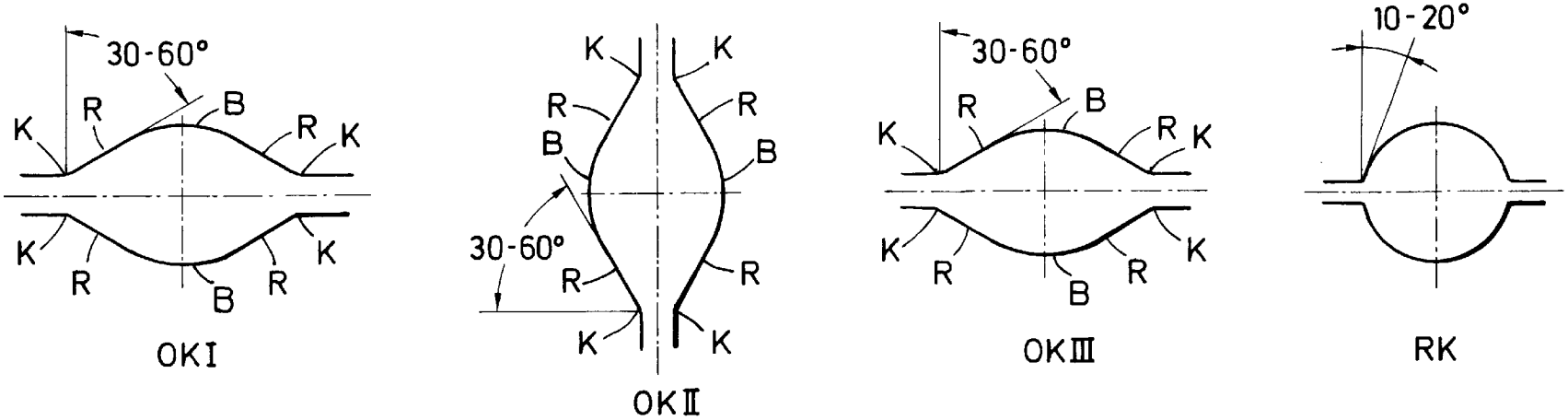
FIG. 2 is an illustration of the pass schedule of a groove sequence in the roll stand arrangement of FIG. 1.

As can be seen in FIGS. 1 and 2, the illustrated skin pass block of a roll stand arrangement having the rolling direction indicated by an arrow includes three successively arranged roll stands WGI, four successively arranged roll stands WGI, WGII, WGIII and WGIV with pairs of grooved rolls KWPI, KWPII, KWPIII and KWPIV which are offset relative to each other by 90° C. The grooves of the first three pairs of grooved rolls, seen in FIG. 2, are correspondingly oval grooves OKI, OKII and OKIII, and the groove of the last pair of grooved rolls KWPIV is a round groove RK.

A static guide unit STF each is arranged in front of and following the pair of grooved rolls KWPI of the first roll stand, and a roller guide unit RF is arranged in front of each of the subsequent roll stands WGII, WGIII and WGIV and a static guide unit STF is arranged following each of these subsequent roll stands.

In the groove sequence illustrated in FIG. 2, the circumferential lines of the oval grooves OKI, OKII and OKIII extend elliptically in the bottom or side area B and, in the adjacent areas R, the circumferential lines extend in straight lines and at acute angles in the direction towards the two groove edges K, wherein these angles are 30° to 60°. The groove RK is a round groove.

Figure 3:
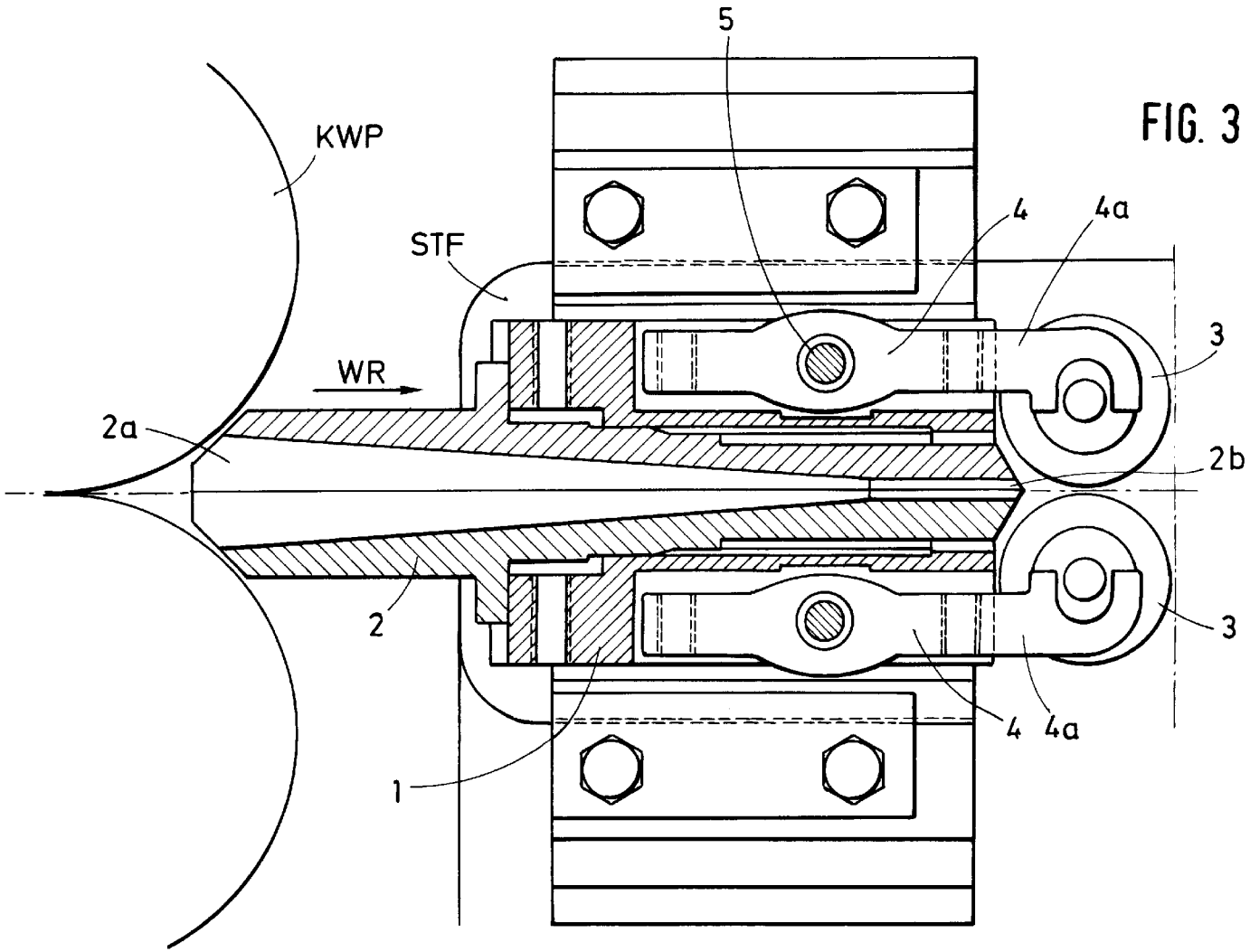
FIG. 3 is a sectional view taken through a static guide unit vertically relative to the rolling plane.

As seen in the rolling direction R, the static guide unit STF illustrated in FIG. 3 is arranged immediately following the pair of grooved rolls of a roll stand, not shown, and is connected to the housing of this roll stand. A wire guide sleeve 2, which can be adjusted in a manner not illustrated, is placed in the guide housing 1 of this static guide unit STF, wherein the guide duct of this sleeve narrows in a manner forming a groove from the entry opening 2*a* at the roll gap of the pair of grooved rolls KWP towards the exit opening 2*b*. Arranged on both sides of the wire guide sleeve 2 are the rolls 3 of a pair of rolls which are mounted on the free ends 4*a* of a double-arm lever pair 4 which are in turn pivotable about bearing bolts 5 arranged in the guide housing 1. The levers of the single-arm lever pair 4 are supported by adjustable springs relative to the guide housing 1.

Figure 4:
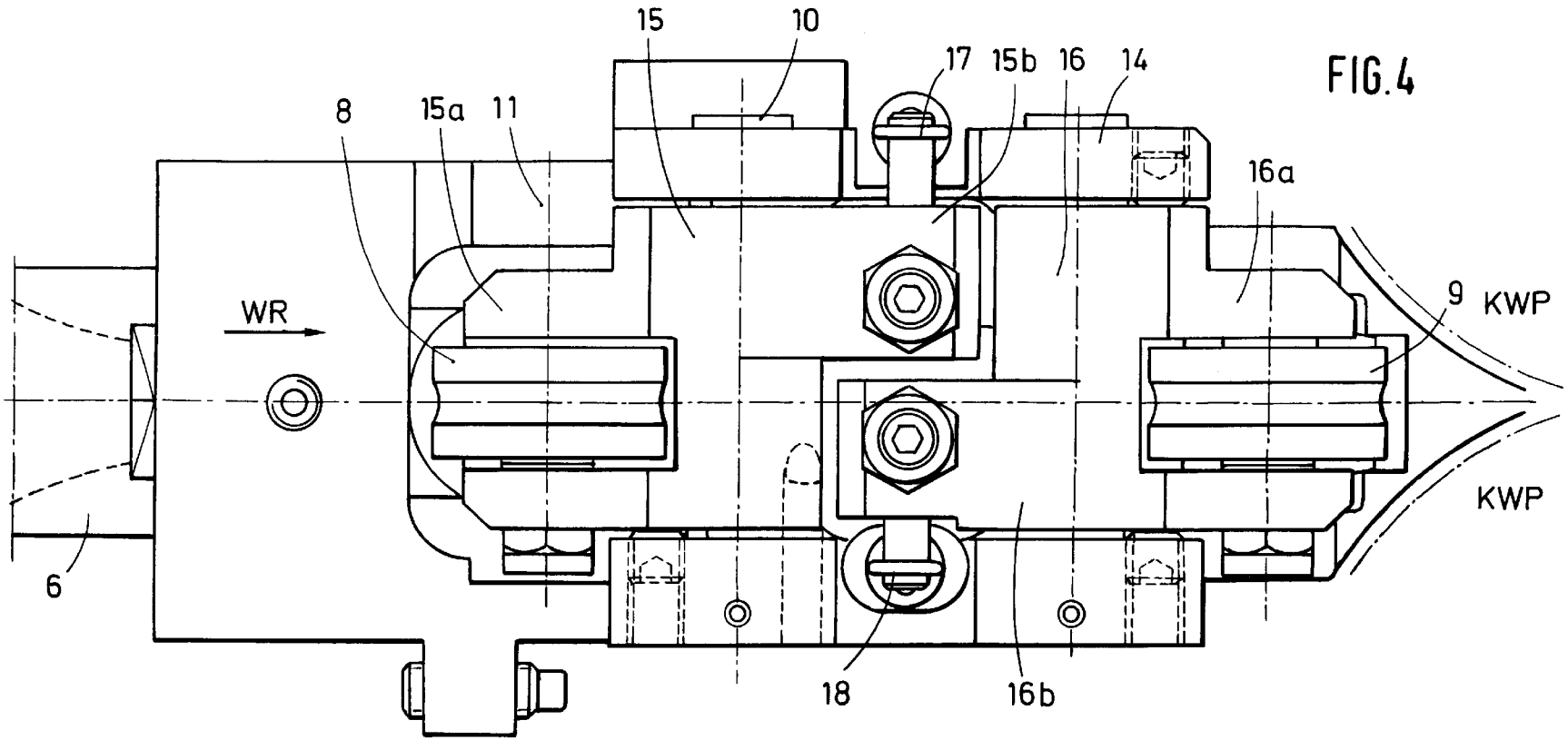
FIG. 4 is a side view of a roller guide unit.
Figure 5:
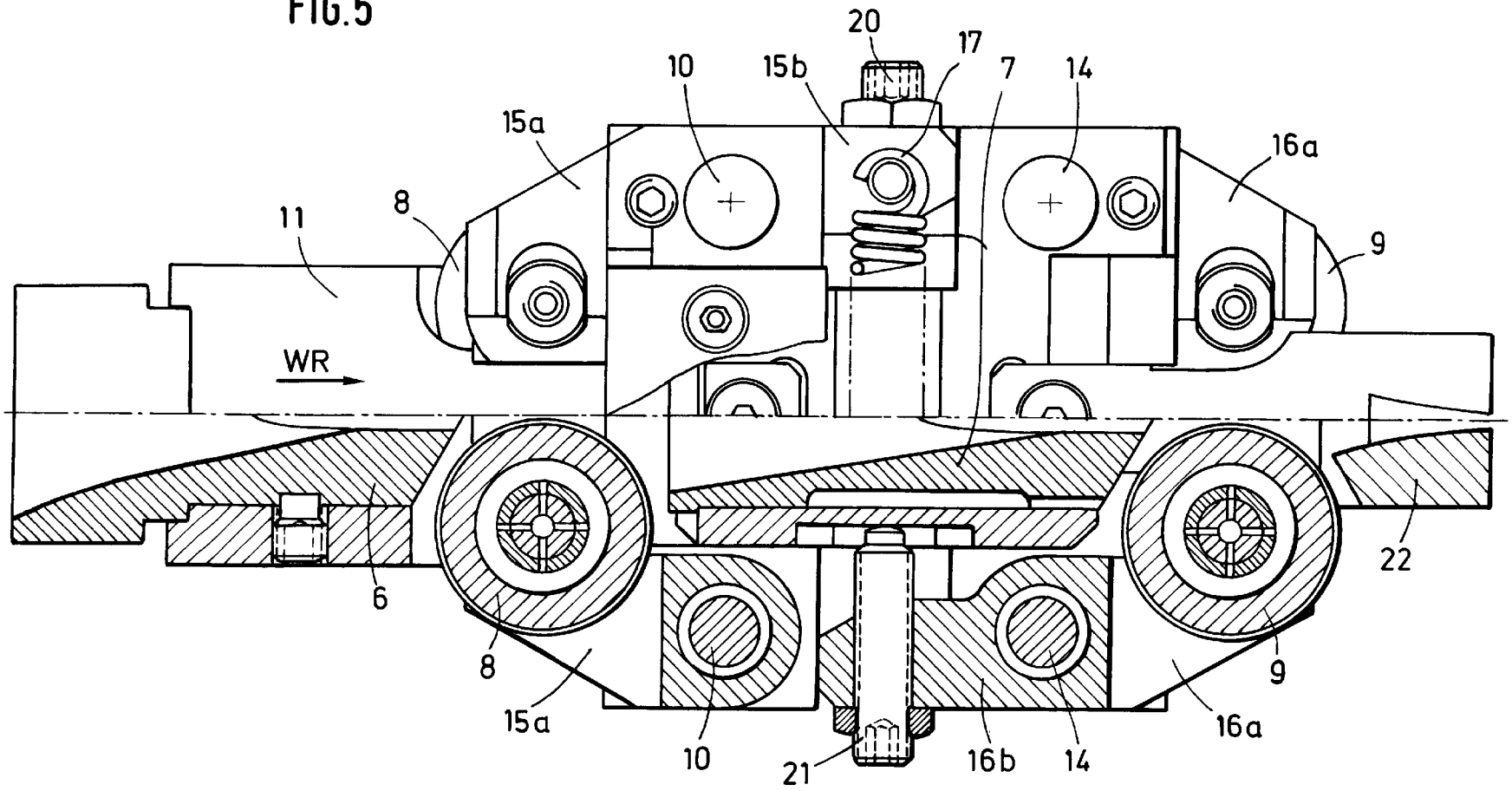
FIG. 5 is a top view, partially in section, of the roller guide unit of FIG. 4.

The roller guide unit RF illustrated in FIGS. 4 and 5 and arranged following the static guide unit STF, is located immediately in front of the pair of grooved rolls KWP of the subsequent pair of grooved rolls in the rolling direction WR. Arranged one behind the other in the rolling direction in the guide housing 11, the roller guide unit includes a first partial wire guide sleeve 6 and a second wire guide sleeve 7 and, also in the rolling direction, a first guide roller pair 8 and a second guide roller pair 9. The first guide roller pair 8 is arranged between the first partial wire guide sleeve 6 and the second partial wire guide sleeve 7 and the second guide roller pair 9 is arranged behind the second partial wire guide sleeve 7. The guide roller pairs 8 and 9 are each supported at the first ends 15*a* or 16*a* of two-arm lever pairs 15 and 16 which are pivotable about bearing bolts 10 or 11, respectively, in the guide housing 11. The other ends 15*b* and 16*b* of these lever pairs 15, 16 are connected to each other on the outside by a tension spring 17 or 18, respectively, and are adjustably supported relative to the guide housing 11 by means of threaded adjustment bolts 20 or 21. A guide projection 22 which forms a continuation of the partial wire guide sleeve 7 is provided in the rolling direction WR behind the second guide roller pair 9 at the guide housing 11 and in front of the roll gap of the pair of grooved rolls KWP.

The use of the first static guide unit STF and the subsequently arranged roller guide unit RF ensures a safe guidance of the wire strand from the oval groove of one roll stand into the subsequent roll stand which is offset by 90°. The rolls can be positioned optically, for example, by means of laser controls.

The invention is not limited by the embodiments described above which are presented as examples only but can be modified in various ways within the scope of protection defined by the appended patent claims.

We claim:

1. A roll stand arrangement for rolling wire comprising a finishing block comprised of fixedly connected roll stands with grooved rolls arranged following a last stand of an intermediate group of a wire rolling train, and a skin pass block comprised of fixedly connected roll stands with grooved rolls, wherein the roll stands of the skin pass block have a groove sequence comprising two, three, four or more oval/oval successive grooves and, following the oval/oval successive grooves, one or two round grooves, further comprising static guide means mounted in front of and following a first roll stand, and a roller guide means mounted in front of each of subsequent roll stands and a static guide means mounted following each subsequent stand.

2. The roll stand arrangement according to claim 1, comprising a reduction per groove in the oval grooves of 10–28% and in the round grooves of 2.5–10%.

3. The roll stand arrangement according to claim 1, comprising a range of diameters of the grooved rolls of between 100 and 210 mm.

4. The roll stand arrangement according to claim 1, wherein the roll stands are spaced apart in a rolling direction by a distance of between 400 and 900 mm.

5. The roll stand arrangement according to claim 1, wherein the roll stands in the skin pass block are configured to be coupled one of individually and in pairs to independent drive units.

6. The roll stand arrangement according to claim 1, comprising cassettes in which pairs of grooved rolls are arranged with support shafts and bearings therefor, wherein the cassettes are configured to be placeable into a part of the roll stand with a drive transmission gear units, and wherein the cassettes are configured to be coupled to the gear units.

7. The roll stand arrangement according to claim 1, wherein each static guide means is comprised of a wire guide sleeve arranged adjustably in a guide housing with a guide roller pair arranged downstream, and each roller guide unit is comprised of a wire guide sleeve and two guide roller pairs arranged spaced apart and one behind the other.

8. The roll stand arrangement according to claim 5, comprising shifting gear units between each drive unit and the roll stand.

9. The roll stand arrangement according to claim 7, wherein the wire guide sleeve of the roller guide unit is comprised of two partial wire guide sleeves arranged in a rolling direction in front of and between the guide roller pairs.

10. The roll stand arrangement according to claim 9, wherein the guide roller pairs are mounted at first ends of two-arm levers mounted in the guide housing, and wherein second ends of the levers are engaged spring-biased by adjusting elements resting against the guide housing.

11. The roll stand arrangement according to claim 9, further comprising guide projections for a front guide roller pair in the rolling direction, wherein the guide projections are connected to the guide housing and are arranged at a roll gap of the roll stand.

12. The roll stand arrangement according to claim 9, wherein a spacing of roll axes is equal to two to four times a diameter of the rolls.

* * * * *